US006240857B1

(12) United States Patent
Elizer

(10) Patent No.: US 6,240,857 B1
(45) Date of Patent: Jun. 5, 2001

(54) REMOVABLE EASEL SHELF

(76) Inventor: Jeanne W. Elizer, 5551 Sunshine Canyon Dr., Boulder, CO (US) 80302

( * ) Notice: Subject to any disclaimer, the term of this patent is extended or adjusted under 35 U.S.C. 154(b) by 0 days.

(21) Appl. No.: 09/257,557

(22) Filed: Feb. 25, 1999

(51) Int. Cl.[7] ..... A47B 5/00

(52) U.S. Cl. ..... 108/152; 108/147.17; 108/157.13; 211/86.01

(58) Field of Search ..... 248/163.2; 211/107, 211/86.01, 203; 108/108, 110, 147.17, 147.11, 152, 157.1, 157.13, 158.12, 158.13, 151, 160, 42, 69, 77, 143.18, 149

(56) References Cited

U.S. PATENT DOCUMENTS

| | | | | |
|---|---|---|---|---|
| 259,441 | | 6/1882 | Van Kirk . | |
| 1,239,938 | * | 9/1917 | Mrasek | 211/107 X |
| 2,244,861 | * | 6/1941 | Walker, Sr. | 108/152 X |
| 2,649,972 | * | 8/1953 | Weil | 108/152 X |
| 2,751,271 | | 6/1956 | Dessertenne et al. . | |
| 2,984,443 | * | 5/1961 | Bergengren | 108/152 X |
| 3,031,247 | | 4/1962 | Schieve . | |
| 3,097,884 | * | 7/1963 | Alford | 108/152 X |
| 3,145,966 | | 8/1964 | Landon . | |
| 3,368,786 | | 2/1968 | Bulman . | |
| 3,465,893 | * | 9/1969 | Kinney | 108/149 X |
| 4,124,094 | * | 11/1978 | Cande | 108/151 X |
| 4,317,552 | * | 3/1982 | Weidler | 211/203 X |
| 4,372,630 | | 2/1983 | Fuhri . | |
| 4,453,470 | | 6/1984 | Capella . | |
| 4,735,152 | * | 4/1988 | Bricker | 108/152 X |
| 4,809,892 | | 3/1989 | Chinski et al. . | |
| 5,114,023 | * | 5/1992 | Lavin | 211/107 |
| 5,501,423 | | 3/1996 | Roberts . | |
| 5,615,621 | * | 4/1997 | Mengshoel et al. | 108/158.12 X |

* cited by examiner

*Primary Examiner*—Janet M. Wilkens
(74) *Attorney, Agent, or Firm*—Faegre & Benson, LLP

(57) ABSTRACT

A removable shelf assembly for use with a tripod or easel having three legs, including a shelf with at least two boot-shaped cutouts formed in the back edge of the shelf and a pair of support arms, provides a convenient work and storage surface for the tripod or easel user. The removable shelf assembly mounts onto the tripod by attaching the shelf to two of the tripod legs at the cutouts, and attaching the support arms to the same two tripod legs with clamps pivotally mounted at the ends of the support arms. Hooks and holders are also optionally provided with the shelf to facilitate convenient placement of tools and materials adjacent to the shelf.

30 Claims, 9 Drawing Sheets

REMOVABLE EASEL SHELF

FIELD OF THE INVENTION

This invention relates to removable shelves for use with portable tripods and easels.

BACKGROUND OF THE INVENTION

For artists interested in pursuing their art in the great outdoors, known in the industry as plein-air artists, transporting art gear to a desirable outdoor location has historically been a difficult task. In particular, for those desiring to employ artistic mediums requiring the use of an easel, carrying the easel and other required tools and supplies has usually been cumbersome and often impossible, requiring multiple trips to transport all of the gear, reduction of the materials taken along, or abandonment of the artistic session altogether.

For many years, a collapsible wooden easel that breaks down into a box with a handle has been the mainstay of the plein-air artist as the only available portable easel with a storage/work surface. However, this box easel is cumbersome to carry, and is difficult and time consuming to set up and take down.

Lightweight, portable, telescoping tripod easels have also been available for a number of years. However, these too have their drawbacks in that they do not provide a storage/work surface for the artist's materials and tools, making them of limited use to many artists. When working in the outdoors, level and clean surfaces for convenient placement of materials, tools and supplies are usually in short supply, indicating a need for an easel with a storage/work surface.

SUMMARY OF THE INVENTION

A removable shelf assembly is provided that is light weight, easily transportable, and quickly attachable and removable from a tripod or tripod-type easel with three legs. The removable shelf assembly includes a flat storage/work surface in the form of a shelf that preferably attaches to a tripod by two boot-shaped cutouts along the back edge of the shelf and two folding support arms that attach to two front legs of the tripod. The boot-shaped cutouts fit around the same two tripod legs. The shelf slides down with the legs in these cutouts to a desirable height, such that the shelf hangs off the tripod away from the center of the tripod. Each support arm clamps onto the same leg of the tripod as is used for the boot-shaped cutout on that side of the assembly, thus providing stable support for the shelf assembly. The clamps are quickly attachable and detachable without the need for additional tools or external devices.

Optionally included on the shelf are two hooks for hanging materials and tools, such as brush holders or containers of solution. As a further option, two additional holders are provided, hinged to the two side edges in order to fold over the work surface of the shelf, for holding paint tubes, brushes, rags, and other tools or materials. Two external clamps are a still further option that may be attached to the tripod legs under the shelf at the cutouts to supply additional support to the shelf assembly, or to allow the shelf to be adjusted to a higher position along the tripod legs, if desired.

DETAILED DESCRIPTION OF THE INVENTION

Figure 1:
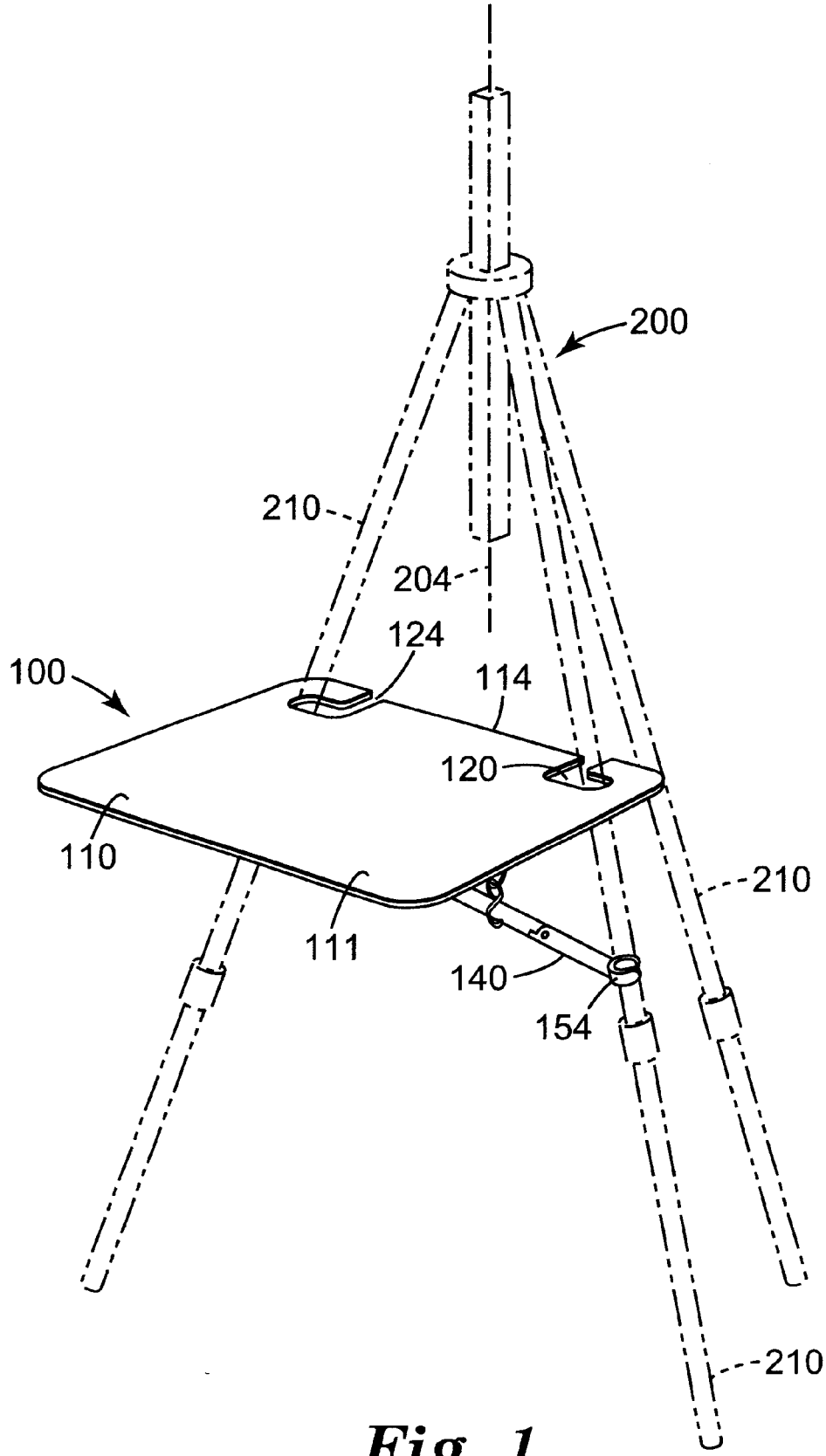
FIG. 1 is a perspective view of a portable tripod easel on which a removable shelf assembly of the present invention has been mounted.

With reference to the attached Figures, it is to be understood that like components are labeled with like numerals throughout the several Figures. FIG. 1 is a perspective view of a removable shelf assembly 100 of the present invention mounted onto a tripod 200, shown in phantom. The removable shelf assembly 100 includes a shelf 110 that mounts onto two of the tripod legs 210 at cutouts 120, 124. The shelf 110 is supported by a pair of support arms (of which one support 140 is shown) that also attach to tripod legs 210 using spring clamps 154. The shelf 110 hangs off the tripod 200 away from the center of the tripod 204, thus providing a level, accessible work and storage surface 111 for an artist or other tripod user. It is to be understood that the term "tripod" as used herein encompasses any tripodic device, that is, one having three legs, for which a work/storage surface would be a useful addition. These devices may include but are not limited to artist easels, display easels, office easels, surveyor tripods, camera tripods, telescope tripods, or tripods for other optical or measuring devices.

The removable shelf assembly 100, in one embodiment, is designed for use with tripods 200 having round legs 210 in the range of about ½ inch to about ¾ inch in diameter. Preferably, the tripod legs 210 are about 12 to 13 inches apart (outside dimension) at the desired shelf height. Although the removable shelf assembly 100 is primarily designed for use with telescoping portable easels that meet these criteria, other types of tripods 200 which also meet these criteria may also be used. Alternately, the design of the removable shelf assembly 100 may be modified in such a way as to accommodate other sizes and types of tripod units 200, including but not limited to square leg tripods, larger diameter tripod legs, longer spaces between tripod legs, and non-easel tripods, without departing from the spirit and scope of the present invention.

Figure 2:
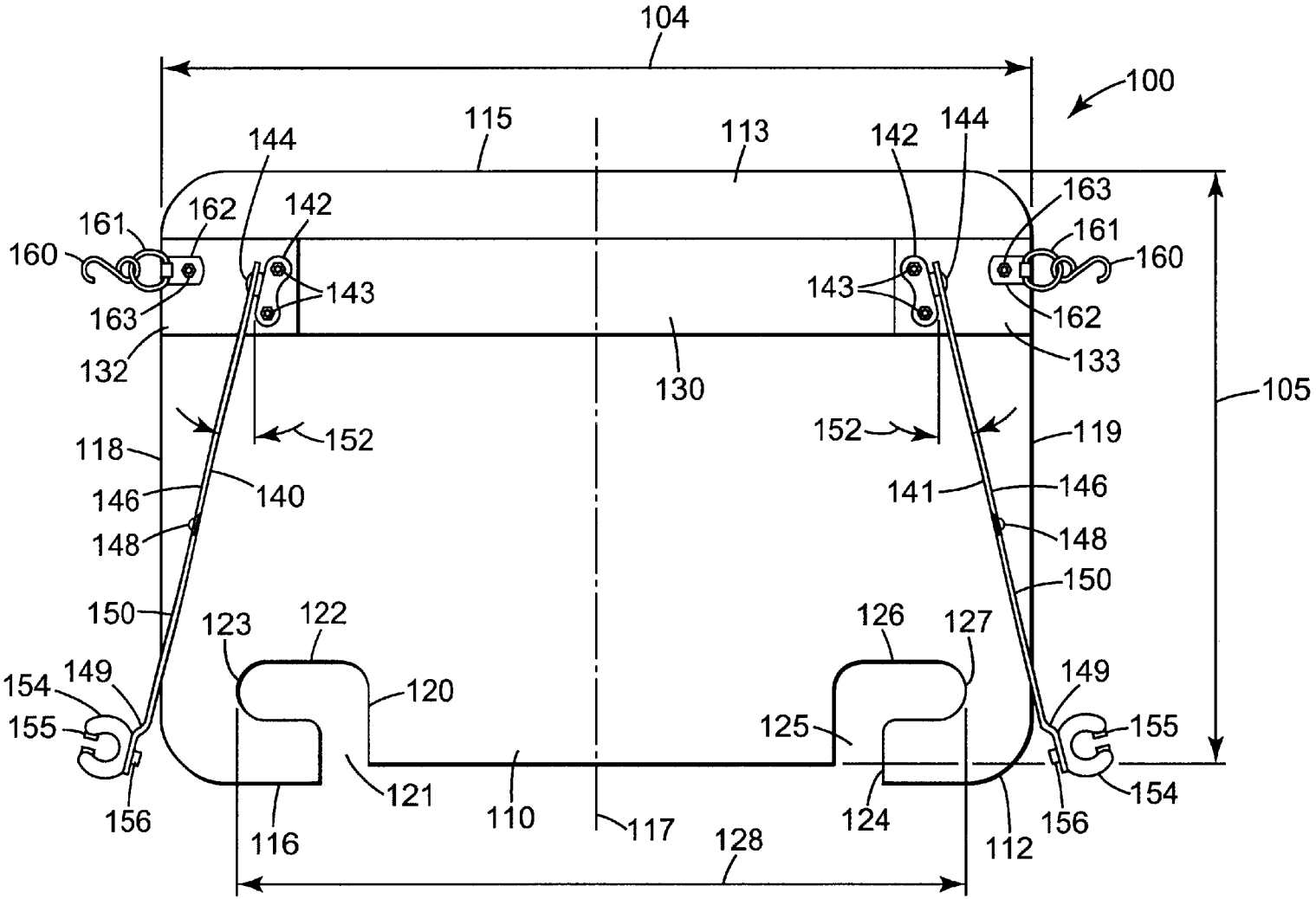
FIG. 2 is a bottom plan view of the removable shelf assembly of FIG. 1 shown in a partially collapsed condition with a pair of arms resting against the shelf.
Figure 3:
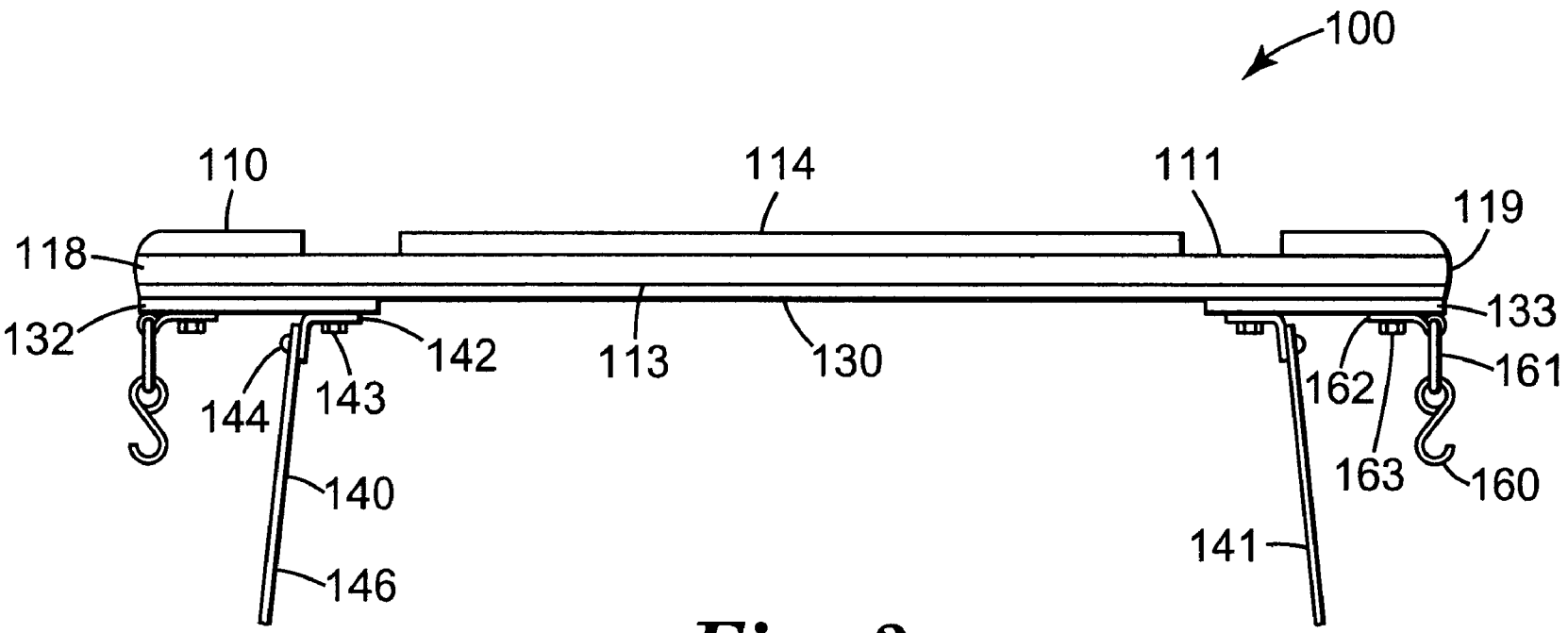
FIG. 3 is a fragmentary front elevation view of the removable shelf assembly of FIG. 1 in a fully deployed condition.
Figure 4:
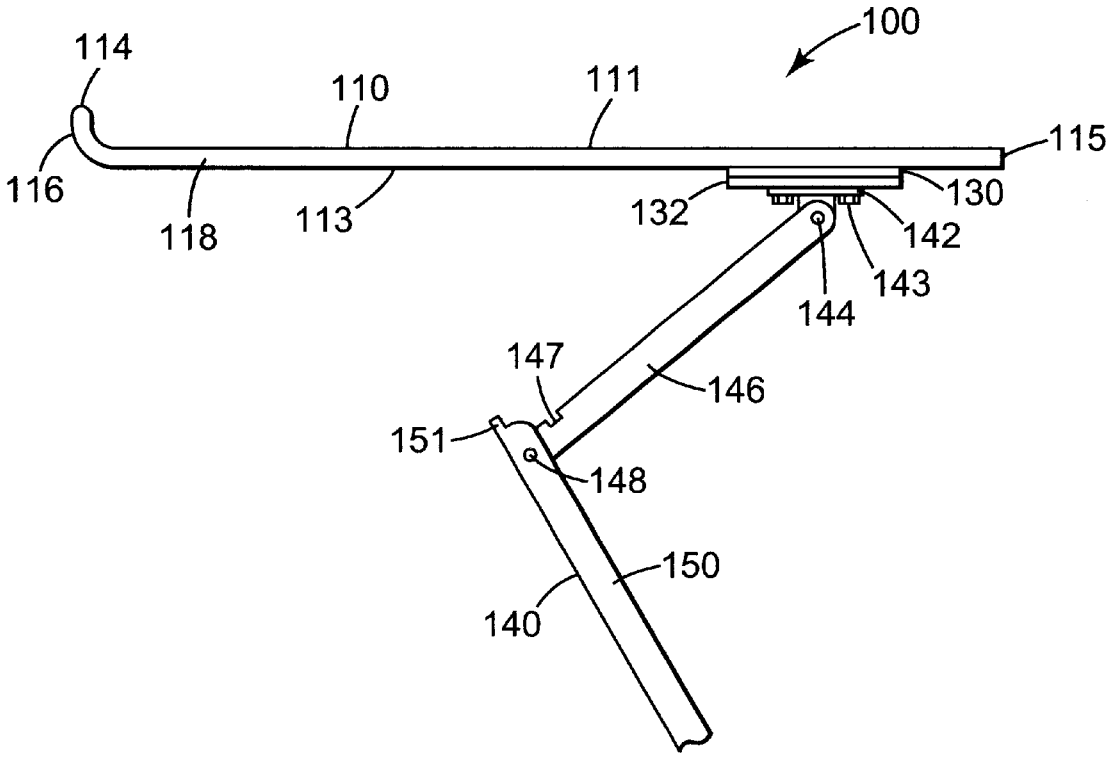
FIG. 4 is a fragmentary side elevation view of the removable shelf assembly of FIG. 1 in a partially deployed condition.

Referring now to FIGS. 2–4, the shelf 110 has a bottom surface 113 on the side opposite the work surface 111 to which the pair of support arms 140, 141 are mounted. The shelf 110 preferably has a width 104 of about 16 inches, and a depth 105 of about 12 inches, allowing the removable shelf assembly 100 to be easily packed into a carrying bag or backpack for transport to an outdoor site. The shelf 110 is formed from a thin sheet of durable material, such as plastic, including acrylic or PLEXIGLAS® acrylic sheet, wood; or a composite. The type of material chosen is based in part on the material strength, durability, flexibility, weight, ease of cleanup, cost and resistance to solvents and other artistic mediums. For example, when the shelf 110 is formed from acrylic the preferred thickness is about ⅛ inch, resulting in the removable shelf assembly 100 weighing less than 1½ pounds. Acrylic is light, readily available, relatively inexpensive, cleans up easily and is sufficiently resistant to typical solvents used by artists. Other material choices may vary in thickness depending on their strength, flexibility and resulting weight. The overall size of the shelf 110 may also vary depending on the size of the tripod 200 on which it is to be used, the work and storage surface area desired, and transportability requirements.

The shelf 110 preferably includes two "boot-shaped" cutouts 120, 124 located along a back edge 116 of the shelf 110, best seen in FIGS. 1 and 2. These cutouts 120, 124 are basically 'L' shaped with rounded corners, having an opening portion 121, 125 at the back edge 116 and an elongated slot portion 122, 126 formed at a right-angle to the opening portion 121, 125, thus looking like a 'boot.' Each cutout 120, 124 is preferably a mirror image of the other along the lengthwise centerline 117, such that the elongated slot portion 122, 126 of each cutout 120, 124 points outward away from the centerline 117.

The longest dimension 128 between the two cutouts 120, 124 is about 13 inches from the toe 123 of one cutout 120 to the toe 127 of the other cutout 124. This dimension 128 sets the limit on the useable distance between the two tripod legs 210 after taking into account the leg width. For the removable shelf assembly 100 to be located at a point on the tripod 200 where the ¾ inch diameter legs 210 are more than 13 inches apart (outside dimension), the boot-shaped cutouts 120, 124 of the shelf assembly 100 must be modified such that the toe to toe dimension 128 is larger than 13 inches. This modification may require increasing the overall width 104 of the shelf 110.

Figure 9:
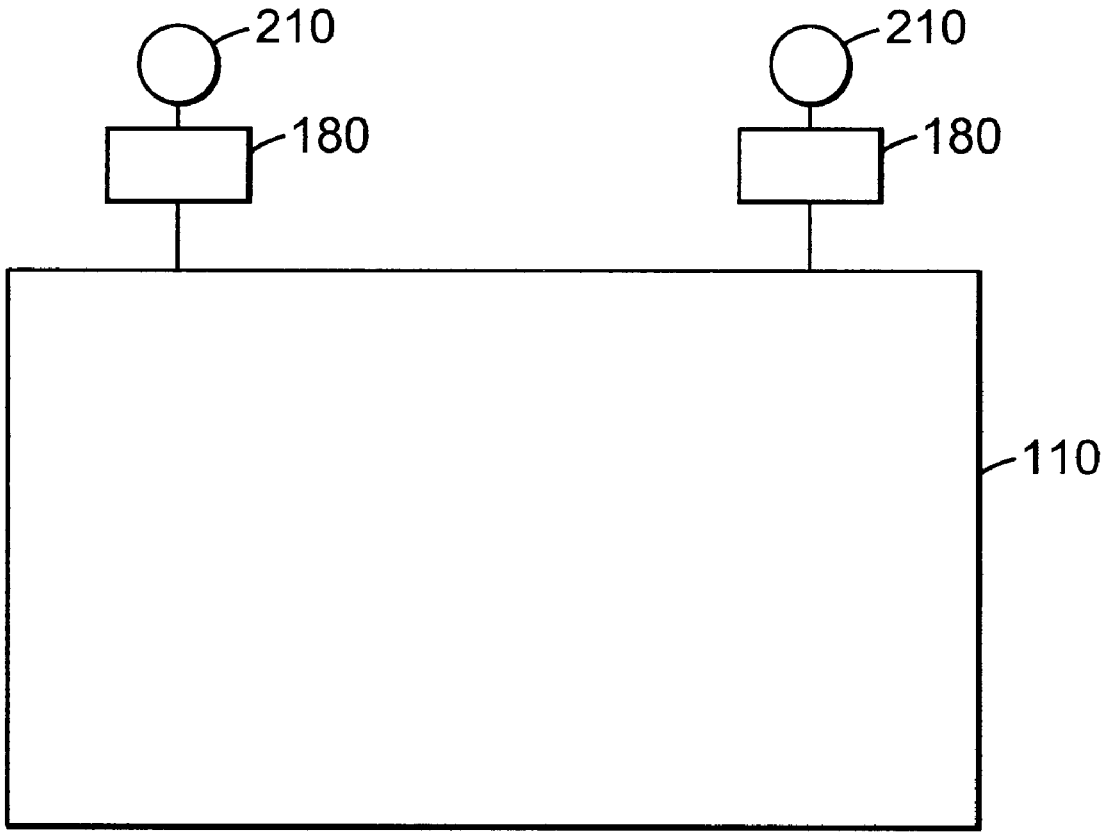
FIG. 9 is a block diagram illustrating the removable shelf assembly of the present invention mounted to legs of a tripod.

Referring to FIG. 9, shelf 110 operatively couples to tripod legs 210 by engagement couplers 180 that, as described above, preferably are cutouts 120, 124. Alternatively, however, engagement couplers 180 may be another coupling device capable of connecting the shelf to two of the tripod legs. The coupling device may be mounted to the back edge of the shelf, or to another suitable location. The coupling device would perform the same function as the boot-shaped cutouts, connecting the shelf to the tripod along the tripod legs such that the shelf cantilevers off of the tripod away from the center of the tripod at a suitable height for a user.

The shelf 110 also preferably includes rounded outside corners 112 to facilitate ease of placement into a carrying device, such as a bag or backpack, as well as limit the possibility of injury to the user by sharp corners. In addition, the shelf 110 may include a back lip 114 formed at the back edge 116. In one embodiment, the back lip 114 is formed by bending the back edge 116 on the work surface side 111 of the shelf 110, as shown in FIGS. 3 and 4. Alternately, the lip 114 may be formed by the addition of material, such as a strip, to the work surface 111 of the shelf 110 along the back edge 116, or by molding, machining, or other formation technique wherein the shelf 110 and lip 114 are integrally formed from the same material. The purpose of the lip 114 formed on the work surface 111 is to keep items from sliding off of the shelf 110, especially when the tripod is placed on uneven terrain.

A reinforcing strip 130 that spans the width 104 of shelf 110 from one side edge 118 to the other side edge 119 is preferably attached to the shelf 110 on the bottom side 113, as may be seen in the embodiment shown in FIGS. 2–5. This reinforcing strip 130 may be formed from the same material as shelf 110, or may be formed from other suitable material. The strip 130 is attached to the shelf 10 by fasteners, adhesive, ultrasonic welding, or other suitable bonding techniques now known or later developed. The strip 130 is preferably about 2⅜ inches wide, is located preferably about 1½ inches from the front edge 115, and serves to reinforce the shelf 110 to reduce bending, buckling or breakage of the thin shelf material. Other reinforcing strip sizes and locations that provide the same function are also within the spirit and scope of the present invention. Alternately, as described above, the reinforcing strip 130 may be integrally formed with the shelf 110, and possibly the lip 114, by molding, machining, or other conventional formation techniques.

Preferably attached to the reinforcing strip 130 at the side edges 118, 119, as shown in FIGS. 2–4, are two mounting pads 132, 133, respectively. Each mounting pad 132, 133 is also formed from the same material as the shelf 110, the same material as the reinforcing strip 130, or from other suitable material. The purpose of the mounting pads 132, 133 is to provide reinforcement regions for the support arms 140, and optional hooks 160, as discussed in more detail below. The mounting pads 132, 133, as shown, are preferably about 2⅞ inches long by about 2⅜ inches wide, the same width as the reinforcing strip 130. The size and location of the mounting pads may vary while still providing that same function. The mounting pads 132, 133 may be attached in the same manner as the reinforcing strip, or by other suitable techniques. Alternately, the mounting pads 132, 133 may be integrally formed with the reinforcing strip 130 alone, or in combination with the shelf 110.

Figure 7:
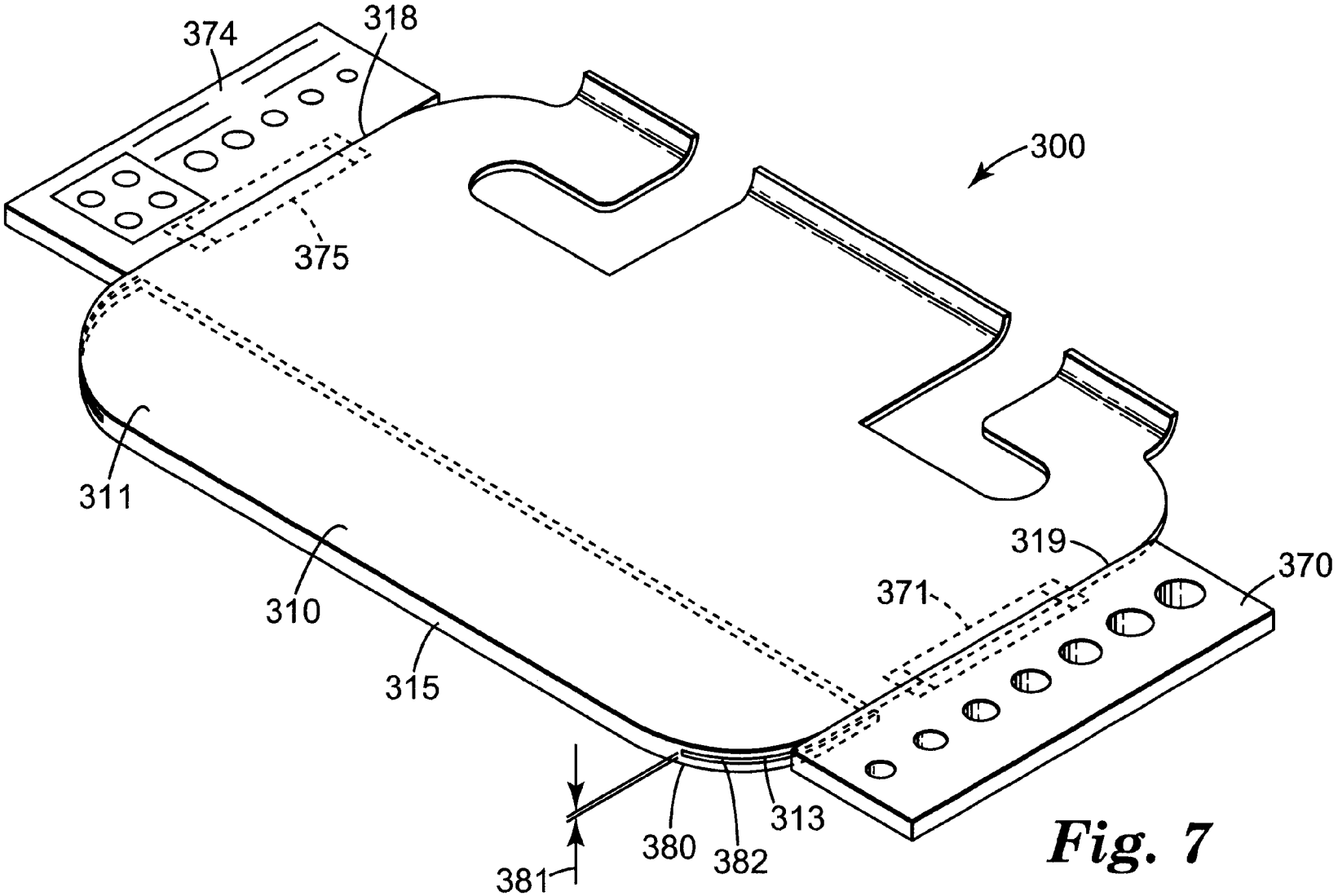
FIG. 7 is a perspective view of another alternate embodiment of the removable shelf assembly with optional hinged holders.

In FIG. 7, an alternate embodiment of a removable shelf assembly 300 is shown in which the reinforcing strip and the mounting pads are replaced by a mounting section 380. This mounting section 380 is formed by bending the material at the front edge 315 of shelf 310 under itself a suitable distance, and then shaping the front edge 315 of the shelf as desired. The mounting section 380, as shown, is preferably about 3¾ inches deep and extends the full width of the shelf 310. The mounting section 380 is spaced a distance 381 from the bottom surface 313 of about ⅛ inch. This gap 382 provides space for the attachment of fasteners, as described more below. When assembly 300 is formed of plastic, it is to be understood that the plastic is to be heated sufficiently to permit such bending.

Referring now back to FIGS. 2–4, the support arms 140, 141 are attached to the shelf 110 at the mounting pads 132, 133, respectively. As each support arm 140, 141 is the same, except mounted as a mirror image of the other about the centerline 117, only support arm 140 will be discussed in detail. The support arm 140 is articulated, somewhat flexible, and includes a mounting bracket 142 that is attached to the shelf 110 at mounting pad 132 (attachment of the mounting bracket 142 will be discussed in more depth below). The support arm 140 is pivotally connected to a first arm portion 146 by pin 144. The pivotal connection at pin 144 provides a 180° freedom of movement of the support arm 140 with respect to bracket 142 and shelf 110. Pivotally connected to the first arm portion 146 at pin 148 is a second arm portion 150. The pinned connection at pin 148 allows the support arm 140 to fold, as shown in FIG. 4, thus reducing the overall size of the removable shelf assembly 100 and facilitating storage, packing and transport of the shelf assembly 100. The components (142, 144, 146, 148, and 150) of the support arm 140 are formed of brass, which provides some flexibility in the support arm 140, as well as sufficient strength and durability. This flexibility allows for some adjustment of the support arms 140, 141 in and out with respect to the centerline, to accommodate variations in tripod structure. However, other types of materials that also provide flexibility, durability and strength, including other metals or non-metals, are also within the contemplation and scope of the present invention for any or all of the support arm components.

Preferably, the first arm portion 146 is provided with a notch 147, and the second arm portion 150 is provided with a tang 151, so as to limit rotation of the second arm portion 150 about pin 148 in one direction. The tang 151 inserts into notch 147 when the support arm 140 is fully extended, as shown in FIG. 2. This "locking" of the support arm 140 keeps the arm 140 from collapsing when a load is applied to the shelf assembly 100 when mounted onto a tripod 200.

The second arm portion 150 includes a bent offset 149 at the end opposite from the end pinned at 148. Attached to this offset 149 is a spring clamp 154. As shown in FIG. 2, the spring clamp 154 is bent spring steel designed for quick clamping and release about a member, such as the leg 210 of tripod 200, without the need for tools or other external devices. The spring clamp 154 shown is a readily available item known in the industry. Alternately, another suitable clamp may be used. Other types and designs of clamps suitable for the present purpose may also be substituted without deviating from the spirit and scope of the present invention.

The spring clamp 154 is attached to the offset 149 by a fastener 156, which preferably leaves the spring clamp 154 free to rotate. However, other types of attachments may also be used that also preferably allow the spring clamp 154 to rotate. The rotational ability of the spring clamp 154 provides more versatility in the type of tripod or easel leg to which the spring clamp 154 may be attached. It is to be understood that the term "fastener," as used herein, includes but is not limited to screws, bolts, rivets, pins, and other mechanical fasteners. Also included on the spring clamp 154 are pads 155 that are a felt-type material adhered to the inside of the clamp 154, for protecting the tripod legs 210 from damage during attachment and detachment of the clamp 154. Other types of pad designs, locations and materials are also acceptable.

As shown in FIGS. 2–4, the support arm 140, is preferably attached by fasteners 143 to shelf 110 at an acute outward angle 152 of about 15° relative to the centerline 117. The angled attachment accommodates the angle of the tripod legs 210 when the removable shelf assembly 100 is mounted to the tripod 200. In one embodiment, the fasteners 143 attach the support arm 140 to the mounting pad 132 and reinforcing strip 130 combination, with the surface of the fastener 143 flush with one surface of reinforcing strip 130. The reinforcing strip 130 is then attached to the surface 113 of the shelf 110, thereby eliminating fasteners on the working surface 111 of the shelf 110. Other methods of fastener mounting are also contemplated and within the scope and spirit of the present invention. Alternately, the support arms 140, 141 may be removably attached to the shelf 110 in a suitable manner so that the support arms 140, 141 may be stored or transported separate from the shelf 110.

Figure 5:
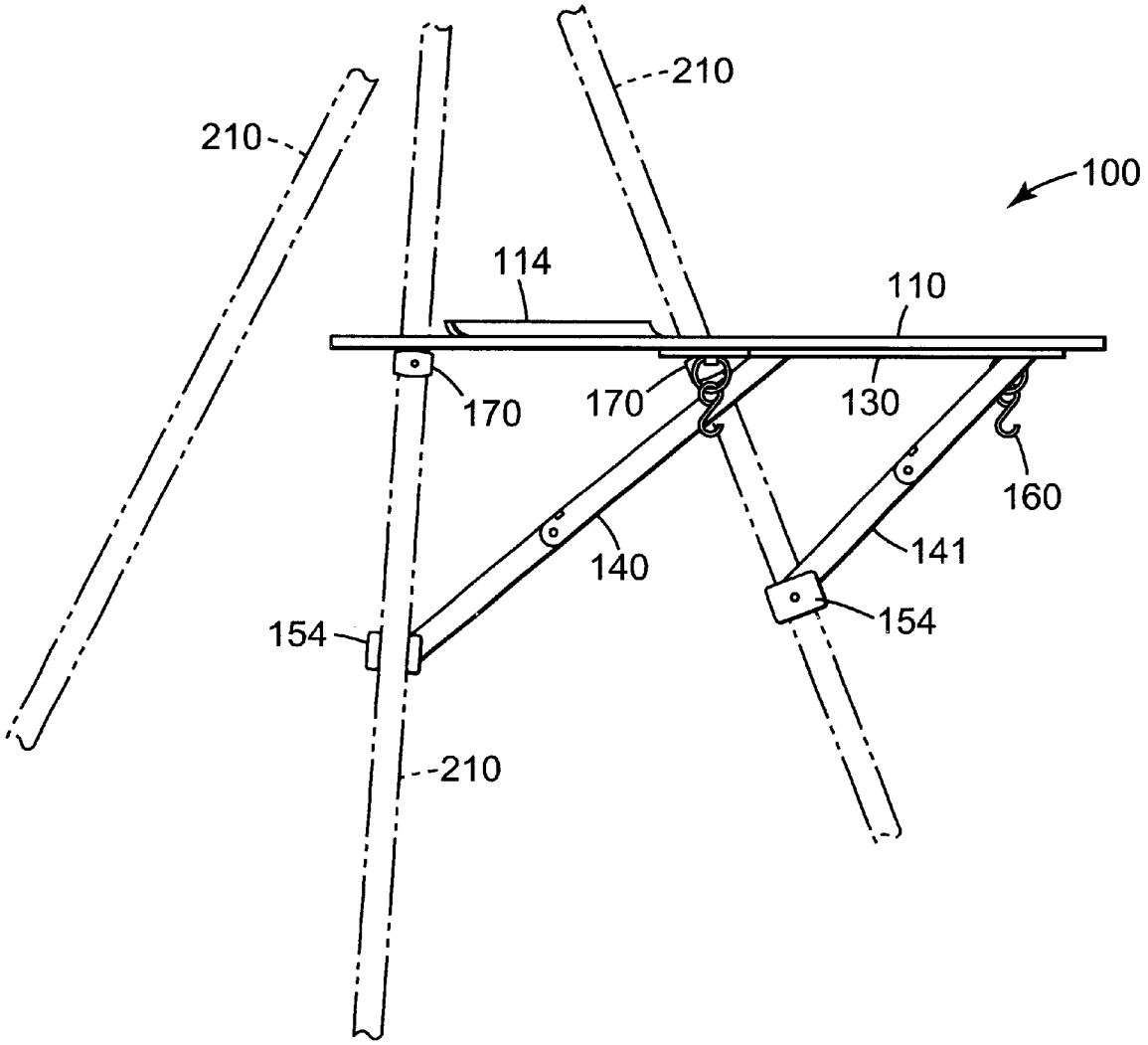
FIG. 5 is an elevational view of the removable shelf assembly mounted on the portable easel of FIG. 1 as viewed from a front corner thereof.

In FIGS. 2, 3 and 5, hooks 160 are also shown attached to the shelf 110 at mounting pads 132, 133. Each hook 160 preferably has an 'S' shape with one end connected to an eye 161. The eye 161 is rotatably connected to an eye mount 162 that is attached to the mounting pad 132, 133 by a fastener 163. As shown in FIGS. 3 and 5, these hooks 160 hang down on either side 118, 119 of the shelf 110, providing a way for the user to attach various needed items to the shelf assembly 100. These items could include such things as a brush holder, rags, a drink holder, or a holder for other artistic materials, such as solvents, cleaners, or paints. The addition of the hooks 160 adds versatility to the removable shelf assembly 100.

As shown in FIGS. 1 and 5, the removable shelf assembly 100 attaches to the tripod 200 by simultaneous insertion of two of the tripod legs 210 into the cutouts 120, 124. The shelf assembly 100 slides down the legs 210 until the legs 210 reach the toes 123, 127 of the cutouts 120, 124. The support arms 140, 141 are then extended until "locked" and the spring clamps 154 are fastened onto the same tripod legs 210 used for the cutouts 120, 124, from the inside (as shown). The support arms 140, 141 support the shelf 110 when downward loads are applied to it, such as the weight of materials and/or the force of someone or something leaning on the shelf 110, thus providing a stable work surface for the user. In addition, the support arms 140, 141 allow the shelf 110 to be adjusted into a level position no matter what angle the tripod 200 is setup at or ends up at, depending on the needs of the artist or the type of terrain upon which the tripod 200 is placed, respectively. Another benefit the removable shelf assembly 100 provides is added stability for the tripod 200, especially for those tripods or easels that don't have a center support or other means of tying the legs together.

As shown in FIG. 5, included with the removable shelf assembly 100 are two additional spring clamps 170, similar to spring clamps 154, that may optionally be attached to the tripod legs 210 underneath the shelf 110 at the cutouts 120, 124 as shown in FIG. 5. These additional clamps 170 provide further support for the shelf 110 when mounted to the tripod 200. Some tripods, especially the portable telescoping type, may include knuckles or joints at a suitable height for the shelf assembly 100, thus eliminating the need for the additional clamps 170. Alternately, hose clamps (not shown) or other types of suitable clamps may be used for the same purpose. These additional clamps 170 may also be used to support the shelf 110 when the shelf 110 is placed at a point along the tripod legs 210 that is narrower than the maximum toe-to-toe distance 128, but still within the confines of the boot-shaped cutouts 120, 124, thereby raising the height of the shelf 110 with respect to the tripod 200, if desired.

Figure 6:
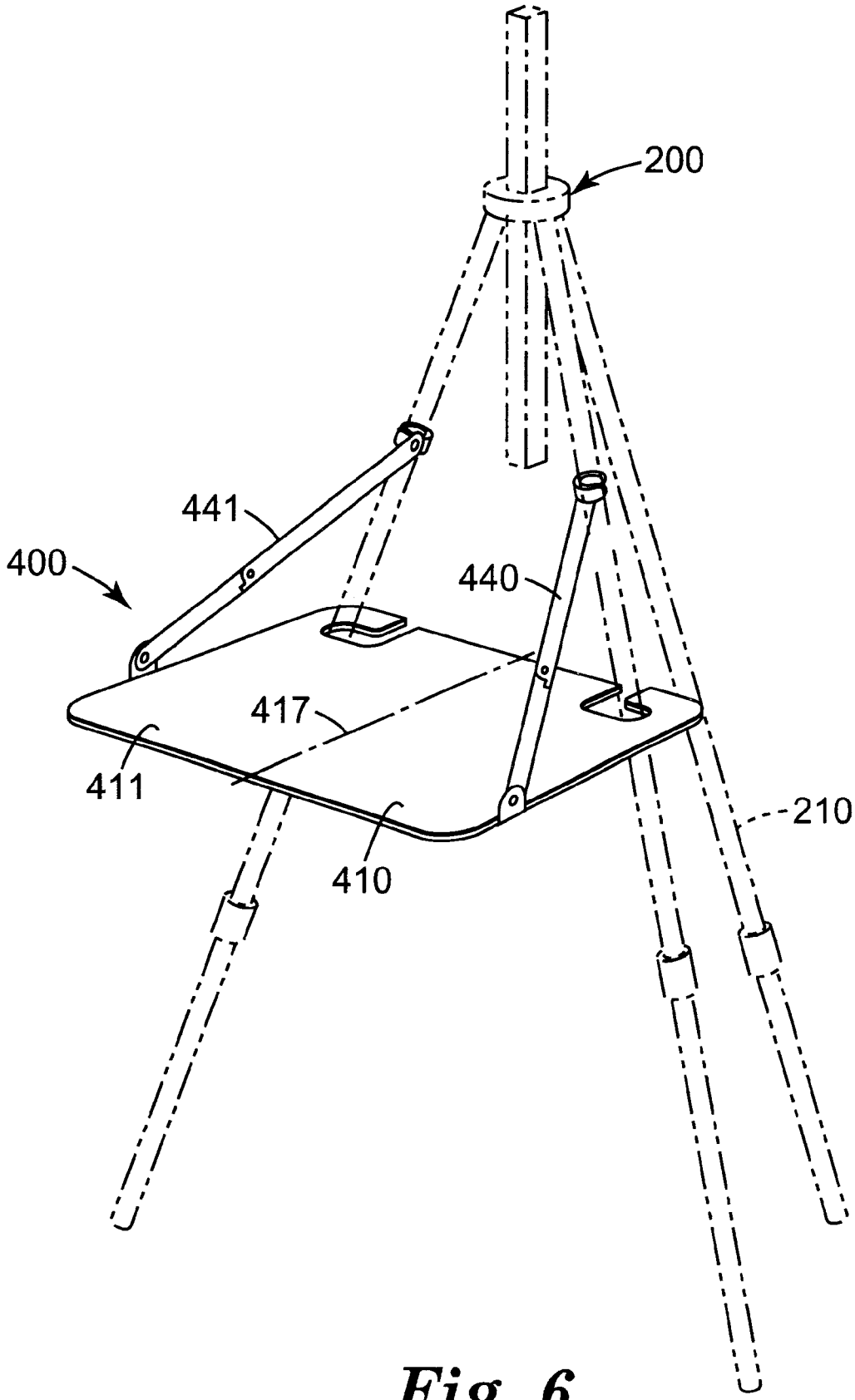
FIG. 6 is a perspective view of an alternate embodiment of the removable shelf assembly, mounted on a tripod easel, having support arms attached to the tripod above the shelf.

In another embodiment, shown in FIG. 6, a removable shelf assembly 400 has support arms 440, 441 that are mounted to the shelf 410 such that they attach to the tripod legs 210 above the work surface 411. In this embodiment, the support arms 440, 441 preferably angle inward toward the centerline 417 to accommodate the angle of the tripod legs 210.

Figure 8:
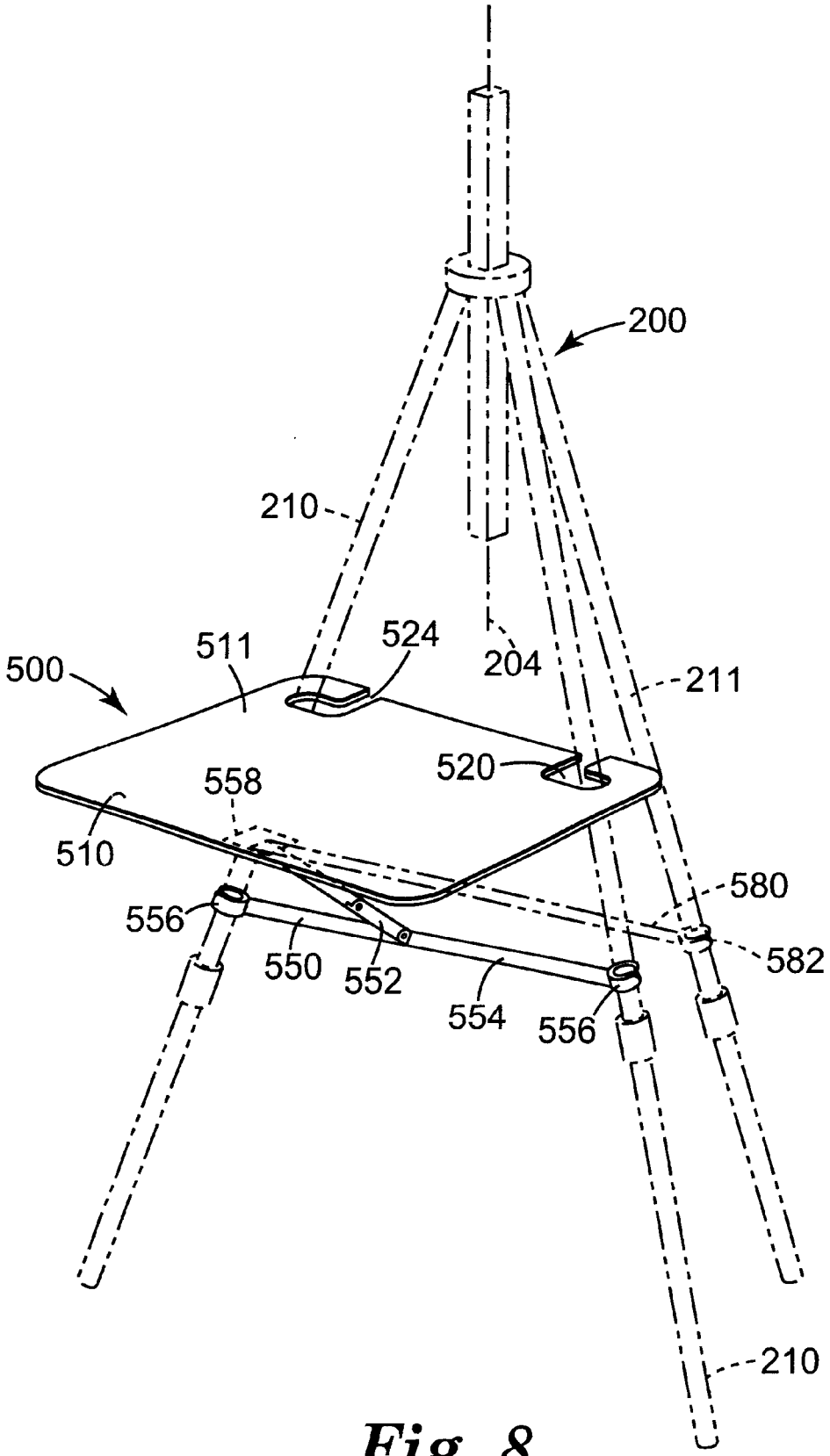
FIG. 8 is a perspective view of yet another alternate embodiment of the removable shelf assembly, mounted on a tripod easel, having a single support arm.

In FIG. 8, yet another embodiment is shown in which a shelf 510 attached to two legs 210 of a tripod 200 by cutouts 520, 524 is supported by a single support arm 550 mounted to the shelf 510, instead of two support arms as described in the embodiments set forth above. This single support arm 550 forms a 'T' support having a center bar 552 and a cross-bar 554, which in turn connects to the two tripod legs 210 at clamps 556. The single support arm 550 is shown mounted to the underside of shelf 510 at mounting pad 558, however any suitable mounting arrangement and method is within the scope and spirit of the present invention.

Alternately, a single support arm 580 (shown in phantom) may be used to support the shelf 510 against the third tripod leg 211, extending from a suitable location, such as mounting pad 558, through the tripod 200 and clamping to the third leg 211 at clamp 582. It is to be understood that, although numerous variations of support arms, such as, for example, number, type, location, material, or connection method, may be created for use with the removable shelf assembly by one skilled in the art, all such variations are contemplated and within the spirit and scope of the present invention.

In FIG. 7, yet another alternate embodiment of the removable shelf assembly 300 is shown including two optional holders 370, 374. These holders 370, 374 are provided to hold paint tubes, clean brushes, used brushes, rags, palette knives, and other artistic tools or materials, in a convenient location for the artist. Each holder 370, 374 is attached to the shelf 310 with hinges 371, 375, respectively, at side edges 318 and 319. These hinges 371, 375 support the holders 370, 374 in a horizontal position, and also allow the holders 370, 374 to be folded up and over the work surface 311 of the shelf 310 for convenient storage and transport.

The removable shelf assembly 100 of the present invention provides a light weight, easily transportable work and storage surface for use with tripods, especially portable tripod easels. The shelf assembly 100 is fast and easy to set up and take down, and requires no additional tools or devices to attach to the tripod. Articulated support arms provide flexible, but sufficient support for the shelf, while still being light weight and accommodating the need for a small overall size. With all of these advantages, the removable shelf assembly of the present invention satisfies the need for a portable work and storage surface attachable to easels and other tripods.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A removable shelf assembly for use with a tripod having three legs, the removable shelf assembly comprising:

a. a shelf having a back edge, a front edge, and two side edges, the shelf including at least two cutouts formed in the shelf along the back edge; and b. at least one support arm connectable to the shelf and attachable to at least one of the legs of the tripod, such that the shelf removably mounts onto the tripod by the attachment of each cutout about at least one of the legs of the tripod, by the connection of the support arm to the shelf and by the attachment of the support arm to at least one of the legs of the tripod.

2. The removable shelf assembly of claim 1, wherein each cutout is boot-shaped.

3. The removable shelf assembly of claim 2, wherein each cutout is formed as a mirror image of the other cutout about a centerline midway between the two side edges of the shelf.

4. The removable shelf assembly of claim 3, wherein each boot-shaped cutout points outward away from the centerline and toward a respective one of the side edges.

5. The removable shelf assembly of claim 1, wherein the shelf assembly comprises two support arms.

6. The removable shelf assembly of claim 5, wherein each support arm is pivotally mounted to the shelf at a pivotal mount.

7. The removable shelf assembly of claim 6, wherein each support arm is mounted at an acute angle relative to a centerline midway between the two side edges of the shelf.

8. The removable shelf assembly of claim 7, wherein each support arm is mounted as a mirror image of the other about the centerline of the shelf.

9. The removable shelf assembly of claim 8, wherein each support arm angles outward from the pivotal mount away from the centerline and toward a respective one of the side edges.

10. The removable shelf assembly of claim 7, wherein each support arm is articulated, and comprises a first arm portion, a second arm portion, and a pivotal joint, the first arm portion pivotally mounted to the shelf at one end and the pivotal joint connecting the other end of the first arm portion to an end of the second arm portion.

11. The removable shelf assembly of claim 10, wherein the second arm portion is restrained from further pivotal movement with respect to the first arm portion when the second arm portion aligns with and extends from the first arm portion.

12. The removable shelf assembly of claim 10, wherein the first arm portion and the second arm portion are formed from metal strips.

13. The removable shelf assembly of claim 6, wherein the shelf further comprises a reinforcement portion to which the two support arms are pivotally mounted.

14. The removable shelf assembly of claim 13, wherein the reinforcement portion is formed by bending the front edge of the shelf, such that the reinforcement portion is substantively parallel to the shelf.

15. The removable shelf assembly of claim 5, wherein each support arm includes a clamp for attaching to at least one of the tripod legs.

16. The removable shelf assembly of claim 15, wherein the clamp comprises a spring clamp.

17. The removable shelf assembly of claim 16, wherein the spring clamp is pivotally mounted to the support arm.

18. The removable shelf assembly of claim 1, wherein the shelf includes a lip along the back edge.

19. The removable shelf assembly of claim 18, wherein the lip is formed by the back edge of the shelf being bent upward.

20. The removable shelf assembly of claim 1, wherein the shelf further includes at least one hook for hanging items therefrom.

21. The removable shelf assembly of claim 1, wherein the shelf further includes at least one holder for holding items adjacent the shelf, the at least one holder hingeably mounted to the shelf such that the at least one holder folds substantially flat against the shelf during storage.

22. The removable shelf assembly of claim 1, further including at least two removable clamps separate from the shelf and support arm, each for placement about one of the tripod legs under one of the cutouts of the shelf for additional support of the shelf when attached to the tripod.

23. A method of forming a work and storage surface area on a tripod, the method comprising the steps of:

a. providing a tripod having three legs;

b. providing a removable shelf assembly having at least two cutouts along a back edge and at least one support arm connectable to the shelf assembly and attachable to at least one of the legs of the tripod; and c. removably attaching the removable shelf assembly to the tripod by engaging each cutout with at least one of the legs of the tripod, by connecting the support arm to the shelf assembly and by attaching the support arm to at least one of the legs of the tripod.

24. A removable shelf assembly for use with a tripod having three legs, including a first leg and a second leg, the removable shelf assembly comprising:

a. a shelf having a back edge, a front edge, two side edges and a centerline between the two side edges, the shelf including a first cutout and a second cutout formed in the back edge; and b. a first support arm and a second support arm each having a first end and a second end, each support arm including a clamp at the first end for attachment to at least one of the legs of the tripod, and each support arm pivotally mounted at the second end to the shelf at an acute angle relative to the centerline of the shelf, such that each support arm is mounted as a mirror image of the other about the centerline of the shelf, and the first support arm is located on the same side of the centerline as the first cutout and the second support arm is located on the same side of the centerline as the second cutout, such that the removable shelf assembly removably mounts onto the tripod by the attachment of the first cutout about the first leg of the tripod, the attachment of the second cutout about the second leg of the tripod, the attachment of the first support arm to the first leg of the tripod and the attachment of the second support arm to the second leg of the tripod.

25. The removable shelf assembly of claim 24, wherein each cutout is boot-shaped, each cutout pointing outward away from the centerline of the shelf toward a respective one of the side edges.

26. A removable shelf assembly for use with a tripod having three legs, the removable shelf assembly comprising:

a. a planar shelf having a back portion adjacent a back edge, a front edge, and two side edges;

b. at least two spaced apart leg engagement couplers proximate the back portion in contact with the shelf, the engagement couplers configured to adjustably couple the shelf to at least two of the tripod legs at a first location; and c. at least one support arm separate from the leg engagement couplers, the support arm mounted to the shelf and configured to attach to at least one of the legs of the tripod at a second location separate from the first location on the tripod legs, such that the shelf removably mounts onto the tripod by the attachment of the at least two leg engagement couplers onto two of the legs of the tripod at the first location and is supported by the attachment of the at least one support arm to at least one of the legs of the tripod at the separate second location.

27. The removable shelf of claim 26, wherein the leg engagement couplers are integral to the shelf.

28. The removable shelf of claim 27, wherein the leg engagement couplers comprise cutouts formed in the shelf along the back edge.

29. The removable shelf of claim 26, wherein the leg engagement couplers comprise fasteners that are mounted to the shelf.

30. A shelf and tripod assembly, the assembly comprising:

a. a tripod having three legs; and b. a removable shelf unit mounted onto the tripod, the shelf unit comprising:

i) a shelf that provides a planar work and storage area for the tripod;

ii) at least two leg engagement couplers in contact with the shelf and coupling the shelf to at least two of the legs of the tripod at a first location; and iii) at least one support arm that is separate from the engagement couplers and mounted to the shelf, the support arm attached to at least one of the legs of the tripod at a second location separate from the first location on the tripod legs where the engagement couplers are coupled, the at least one support arm supporting the shelf from the tripod.

* * * * *